US011122903B2

(12) United States Patent
Sun

(10) Patent No.: US 11,122,903 B2
(45) Date of Patent: Sep. 21, 2021

(54) ROCKABLE FOLDING CHAIR

(71) Applicant: Benlong Sun, Zhejiang (CN)

(72) Inventor: Benlong Sun, Zhejiang (CN)

(73) Assignee: ZHEJIANG PRIDE LEISURE PRODUCTS CO., LTD., Zhejiang Province (CN)

( * ) Notice: Subject to any disclaimer, the term of this patent is extended or adjusted under 35 U.S.C. 154(b) by 0 days.

(21) Appl. No.: 16/748,573

(22) Filed: Jan. 21, 2020

(65) Prior Publication Data

US 2021/0127836 A1 May 6, 2021

(30) Foreign Application Priority Data

Oct. 30, 2019 (CN) ..... 201911041554.5

(51) Int. Cl.
*A47C 4/28* (2006.01)
*A47C 3/025* (2006.01)

(52) U.S. Cl.
CPC ..... *A47C 4/283* (2013.01); *A47C 3/0255* (2013.01)

(58) Field of Classification Search
CPC ..... A47C 3/02; A47C 3/0255; A47C 4/283
(Continued)

(56) References Cited

U.S. PATENT DOCUMENTS 5,577,799 A * 11/1996 St. Germain ..... A47C 5/06 297/18
9,060,611 B2 * 6/2015 Grace ..... A47C 3/027
(Continued)

FOREIGN PATENT DOCUMENTS

CN 110772067 A * 2/2020
CN 211130376 U * 7/2020
(Continued)

*Primary Examiner* — Robert Canfield
(74) *Attorney, Agent, or Firm* — WPAT Law, P.C.; Anthony King

(57) ABSTRACT

A rockable folding chair comprises a chair frame, a reclining cushion, and two rocker assemblies, wherein the chair frame includes a left folding chair frame and a right folding chair frame which are symmetrically arranged and are connected through a middle foldable connection frame, and the two rocker assemblies are respectively symmetrically arranged on the rear sides of the left folding chair frame and the right folding chair frame; each rocker assembly includes an upper rocker, a torsional spring, a lower rocker, and a bottom tube, wherein the lower end of the upper rocker and the upper end of the lower rocker are respectively connected with two ends of the torsional spring, and the lower end of the lower rocker is rotationally connected with the rear end of the bottom tube which is arranged on the ground; the left folding chair frame and the right folding chair frame have bottoms respectively rotationally connected with the bottom tubes as well as rear upper ends respectively articulated to the upper rockers; pluggable back tubes are respectively arranged at rear top ends of the left folding chair frame and the right folding chair frame; and two sides of the upper part of the reclining cushion are respectively fixed to the two back tubes, and two sides of the lower part of the reclining cushion are respectively fixed to the left folding chair frame and the right folding chair frame. The rockable folding chair can be horizontally folded leftwards and rightwards and can rock forwards and backwards, thereby having reliable rocking performance and being convenient to carry.

20 Claims, 11 Drawing Sheets

(58) Field of Classification Search
USPC ..... 297/42, 45, 258.1, 271.5, 272.1, 272.2
See application file for complete search history.

(56) References Cited

U.S. PATENT DOCUMENTS

| | | | | |
|---|---|---|---|---|
| 10,143,309 | B2 * | 12/2018 | Grace | A47C 7/624 |
| 10,448,740 | B1 * | 10/2019 | Frankel | A47C 4/28 |
| 10,568,430 | B1 * | 2/2020 | Sun | A47C 3/025 |
| 2009/0039684 | A1 * | 2/2009 | Chen | A47D 1/006 297/16.1 |
| 2009/0184562 | A1 * | 7/2009 | Wilson | B60N 2/682 297/452.18 |
| 2010/0187866 | A1 * | 7/2010 | Chen | A47C 4/283 297/16.1 |
| 2011/0169304 | A1 * | 7/2011 | Chen | A47C 4/283 297/35 |
| 2014/0097647 | A1 * | 4/2014 | Grace | A47C 3/027 297/42 |
| 2019/0110599 | A1 * | 4/2019 | Grace | A47C 7/443 |
| 2019/0313799 | A1 * | 10/2019 | Frankel | A47C 7/70 |

FOREIGN PATENT DOCUMENTS

| | | | | |
|---|---|---|---|---|
| EP | 0209955 | A2 * | 1/1987 | A47C 4/283 |
| GB | 634008 | A * | 3/1950 | A47C 17/045 |
| JP | 2010213788 | A * | 9/2010 | A47C 4/283 |

* cited by examiner

ROCKABLE FOLDING CHAIR

BACKGROUND OF THE INVENTION

1. Technical Field

The invention belongs to the technical field of furniture for use in daily life, mainly relates to reclining chairs, in particular to a rockable folding chair.

2. Description of Related Art

In modern day, chairs as necessary furniture for daily life allowing people to have a rest to allay their tiredness caused by long-time lying or standing and to reduce energy consumption from this long-term standing have been widely applied to various places such as training institutions, schools, public places, hospitals, restaurants, hotels, companies, and houses to be used by users. The chairs are designed to have various structures, wherein rocking chairs of a special structure are special chairs which are able to rock forwards and backwards to allow people lying thereon to feel happy, to lower the blood pressure, to slow down the breathing, and even to train the balance of human bodies, and are especially suitable for people to relax or for old people to have a rest.

Most existing rocking chairs adopt two symmetrical arc rockers having two arc ends tilting upwards to support the chair bottom during rocking, and a reclining cushion is arranged on the two arc rockers and has two ends fixed to the arc rockers through armrests. The arc rockers and handles of the whole chairs are typically fixedly installed fixedly, and the rocking chairs of the traditional structure cannot be disassembled, thus having a large size and occupying a large area. The whole rocking chairs have to be moved in use, thus being inconvenient to carry and occupying a large space when carried. With the development of science and technology and the demand of people for being close to nature, the rocking chairs which are inconvenient to carry cannot be applied to families, picnics, self-driving tours, outdoor recreation, and so on, and cannot meet the requirements of people for portable reclining chairs for rests and relaxations when people go out to experience life and to relax after heavy work in the current society. Besides, the traditional rocking chairs supported by the arc rockers cannot rock only by means of the contact between arc surfaces of the arc rockers and the ground when used on an uneven ground.

On the basis of the shortcomings of the traditional rocking chairs, the invention carries out research on fabrication technologies relating to reclining chairs to provide a rockable folding chair which is convenient to carry.

BRIEF SUMMARY OF THE INVENTION

The objective of the invention is to provide a rockable folding chair to solve the problem that the existing reclining chairs are large in size and inconvenient to carry.

The technical solution adopted by the invention to fulfill the above-mentioned objective is as follows:

A rockable folding chair comprises a chair frame, a reclining cushion, and two rocker assemblies, wherein the chair frame includes a left folding chair frame and a right folding chair frame which are symmetrically arranged and are connected through a middle foldable connection frame, and the two rocker assemblies are respectively symmetrically arranged on the rear sides of the left folding chair frame and the right folding chair frame;

Each rocker assembly includes an upper rocker, a torsional spring, a lower rocker, and a bottom tube, wherein the lower end of the upper rocker and the upper end of the lower rocker are respectively connected with two ends of the torsional spring, and the lower end of the lower rocker is rotationally connected with the rear end of the bottom tube which is arranged on the ground;

The left folding chair frame and the right folding chair frame have bottoms respectively rotationally connected with the bottom tubes as well as rear upper ends respectively articulated to the upper rockers; and Pluggable back tubes are respectively arranged at rear top ends of the left folding chair frame and the right folding chair frame; and two sides of the upper part of the reclining cushion are respectively fixed to the two back tubes, and two sides of the lower part of the reclining cushion are respectively fixed to the left folding chair frame and the right folding chair frame.

The rockable folding chair is pushed to rock forwards and backwards through the rotation of the torsional springs, and can be folded to be stored, thus being integrally reduced in size.

Furthermore, the left folding chair frame or the right folding chair frame includes a side frame tube, two connection sheets, a support shaft, and two seat support tubes, wherein the side frame tube is a closed ring formed by bending and welding of a tube, and the lower end of the corresponding back tube is necked to be installed in an opening in a rear upper part of the side frame tube in a pluggable manner; the support shaft is arranged at the bottom of the side frame tube and is rotationally connected with the corresponding bottom tube; and the connection sheets are respectively arranged at a front upper part and the rear upper part of the side frame tube, the support tubes are respectively arranged at a front lower part and a rear lower part of the side frame tube, and the connection sheets and the support tubes are respectively connected with the foldable connection frame.

Furthermore, the side frame tubes are quadrangular or pentagonal rings.

Furthermore, the foldable connection frame includes two cross-riveted U-shaped bottom tubes each having two bending ends respectively riveted to the connection sheets located at the front upper part and the rear upper part of the corresponding side frame tube as well as two middle ends respectively riveted to the two seat support tubes located on the corresponding side frame tube.

Furthermore, the support tubes are sleeved with sliding rings; and the lower parts of open ends of the left U-shaped bottom tube are riveted to lug bosses located on the right sliding rings, and the lower parts of open ends of the right U-shaped bottom tube are riveted to lug bosses located on the left sliding rings.

Furthermore, soft supporting pads are arranged at contact parts between a rear lower part of the left folding chair frame or the right folding chair frame and the bottom tubes to reduce frictional loss of repeated contact, caused by rocking in use, of the chair frames and the bottom tubes.

Furthermore, each rocker assembly further includes an upper rocker fixing base, a lower rocker fixing base, and chair frame support bases, wherein the upper rocker fixing base is rotationally connected with the upper rocker, and two ends of the lower rocker fixing base are respectively connected with the lower rocker and the bottom tube; and the rear upper part of the side frame tube is fixedly connected with the upper rocker fixing base, and the support shaft is rotationally connected with the chair frame support base.

Furthermore, each rocker assembly further includes a bottom tube base which is used for supporting a front lower part of the chair frame and arranged at the front end of the bottom tube to support the front end of the chair frame which is used or folded.

Furthermore, the lower rocker fixing base, the chair frame support base, or the bottom tube base has an uneven bottom which is convenient for users to use on an uneven ground.

Furthermore, each rocker assembly further includes an upper torsional spring cover and a lower torsional spring cover which are respectively connected with the upper rocker and the lower rocker, wherein the torsional spring is installed between the upper torsional spring cover and the lower torsional spring cover.

Compared with the prior art, the invention has the following beneficial effects: the rockable folding chair is able to rock forwards and backwards through restoration of the torsional springs, occupies a small area after being folded through a folding design, and is small in overall size and more convenient and faster to carry because the back tubes can be removed when the chair is horizontally folded leftwards and rightwards. Compared with traditional folding chairs provided with arc rockers which can only be used on the horizontal ground, the rockable folding chair of the invention can still rock forwards and backwards normally when used on uneven grounds.

DETAILED DESCRIPTION OF THE INVENTION

Figure 1:
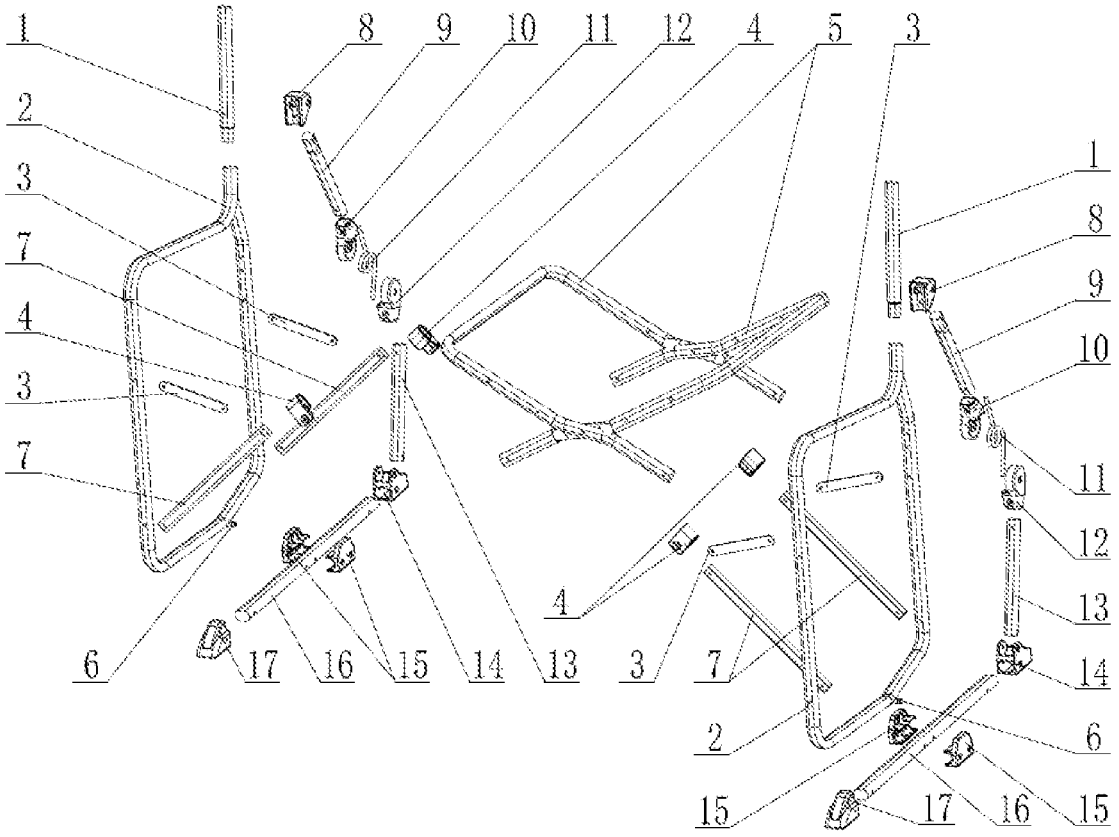
FIG. 1 is an exploded view of a rockable folding chair.
Figure 2:
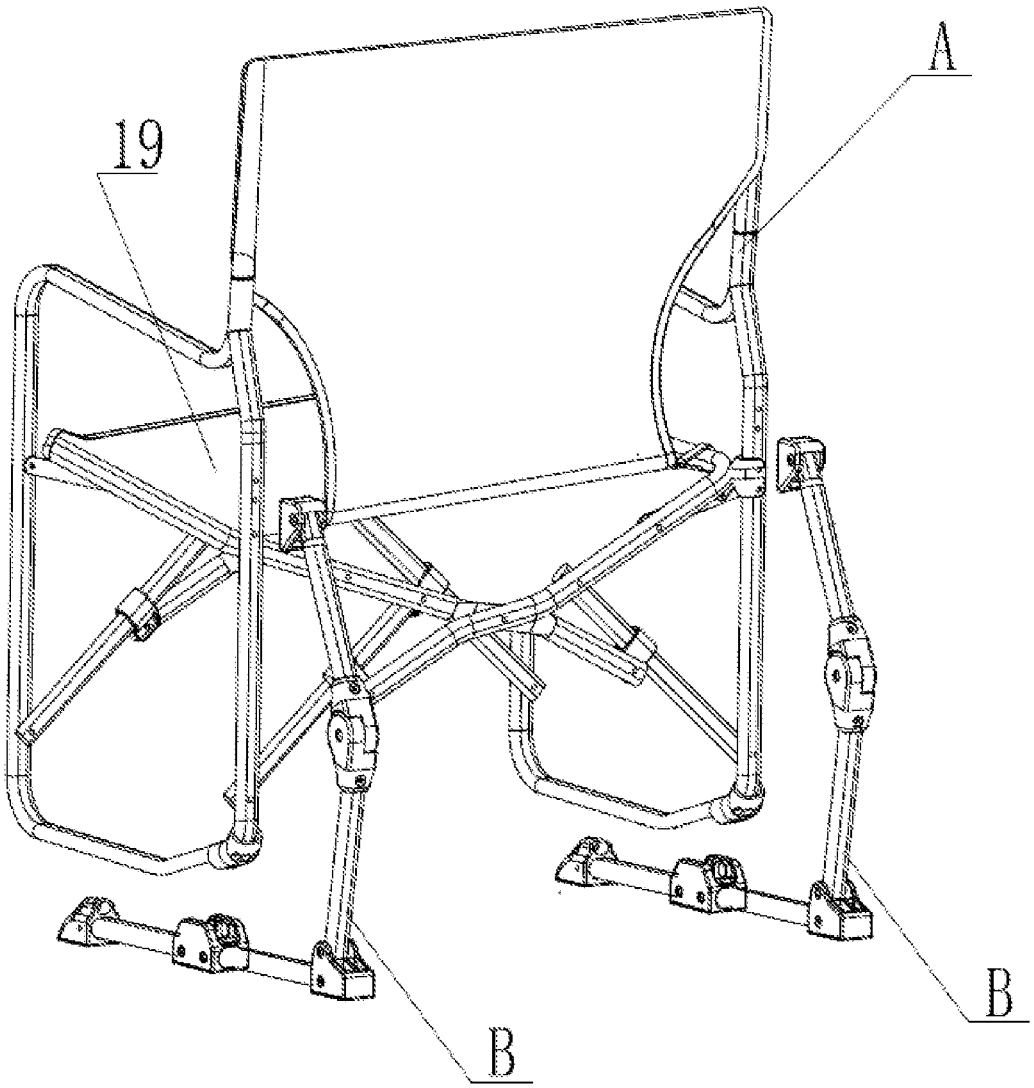
FIG. 2 is a separation diagram of chair frames and rocker assemblies.
Figure 3:
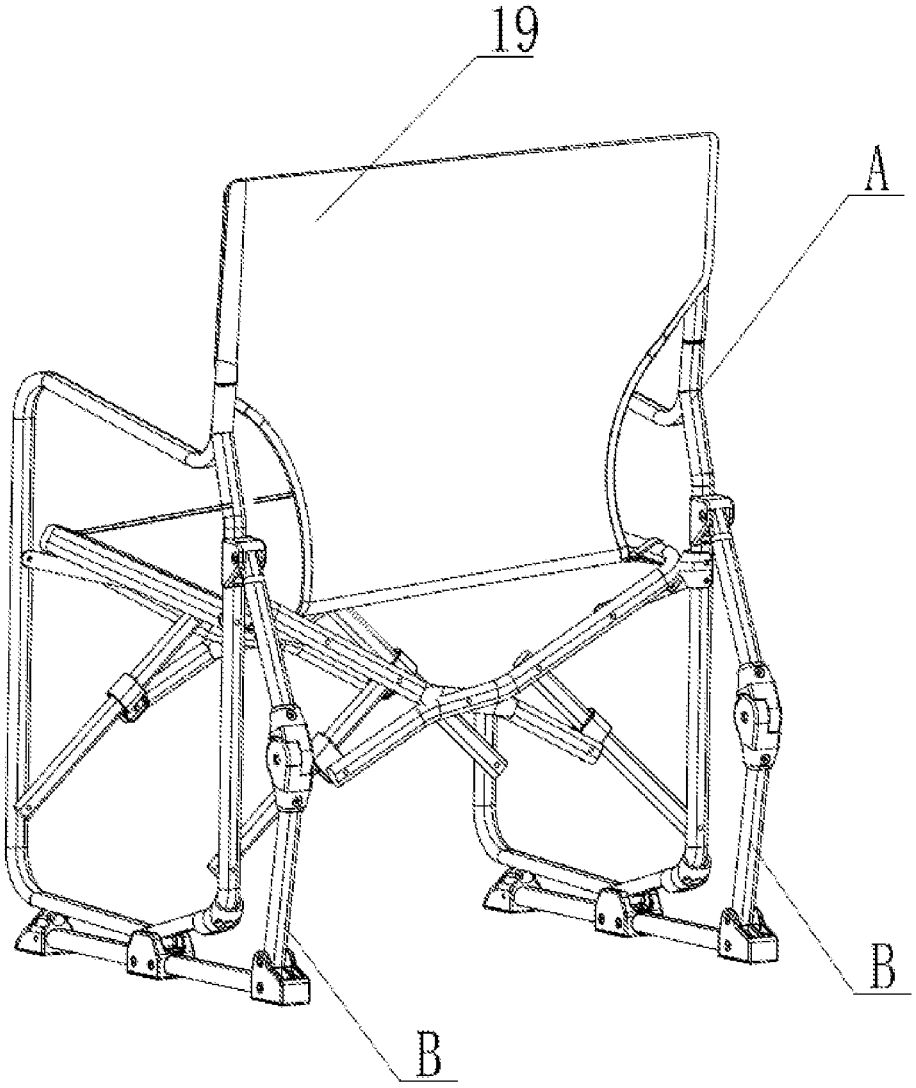
FIG. 3 is a connection diagram of the chair frames and the rocker assemblies.
Figure 4:
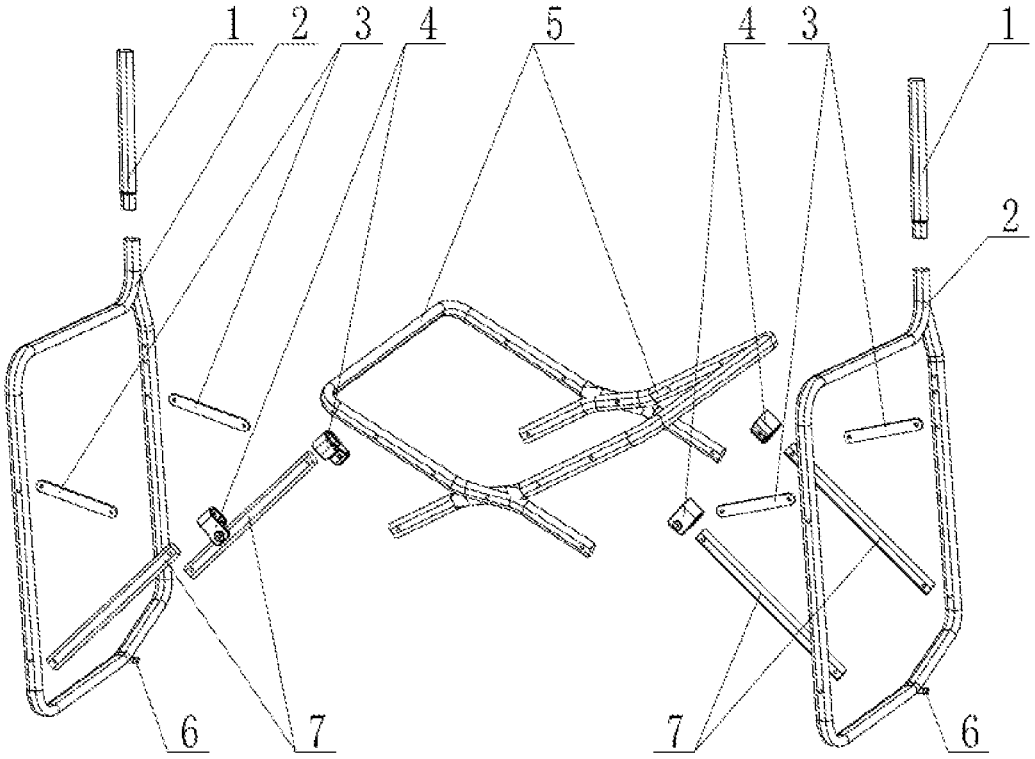
FIG. 4 is an exploded view of the chair frames.
Figure 5:
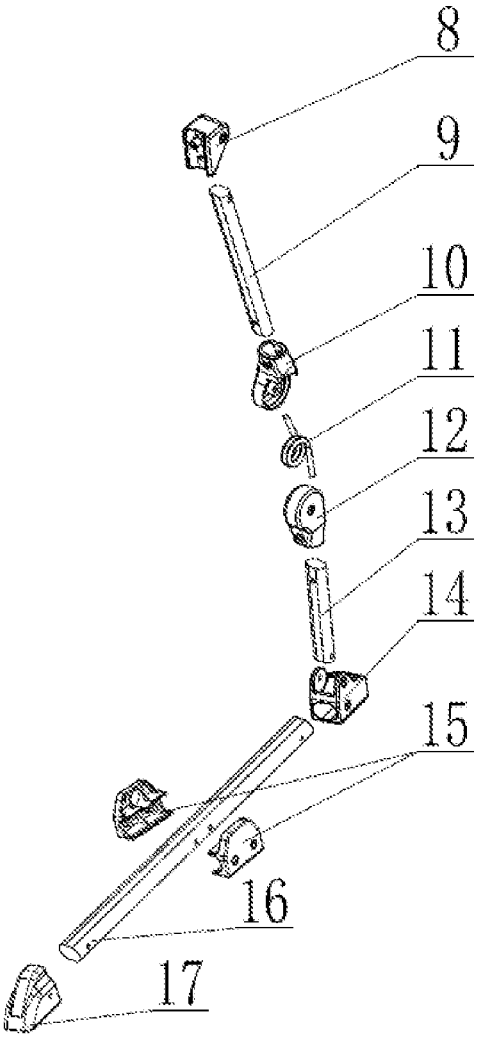
FIG. 5 is an exploded view of one rocker assembly.

For a better understanding of the technical solution of the invention, the technical solution is further expounded as follows in combination with the embodiments. Those skilled in the art can easily appreciate other advantages and effects of the invention on the basis of the contents in the specification, and can implement or apply the invention through other embodiments, and various transformations or changes on the details in the specification can be made on the basis of different opinions and applications without deviating from the spirit of the invention.

This embodiment discloses a rockable folding chair which can be horizontally folded leftwards and rightwards and be pushed to rock forwards and backwards through the rotation of torsional springs, thereby having reliable rocking performance and being convenient to carry.

Referring to FIG. 1 to FIG. 11, the rockable folding chair comprises a foldable chair frame A, a reclining cushion 19, and two rocker assemblies B, wherein the reclining cushion 19 is arranged on the chair frame A, and the two rocker assemblies B are symmetrically arranged on the rear side of the chair frame A.

Each rocker assembly B includes an upper rocker fixing base 8, an upper rocker 9, a torsional spring 11, a lower rocker 13, a lower rocker fixing base 14, chair frame support bases 15, and a bottom tube 16, wherein the upper rocker fixing base 8 is arranged at the upper end of the upper rocker 9, the lower end of the upper rocker 9 and the upper end of the lower rocker 13 are respectively connected with two ends of the torsional spring 11, and the lower rocker fixing base 14 is connected with the lower end of the lower rocker 13 and the rear end of the bottom tube 16; a rear upper end of the chair frame is fixedly connected with the upper rocker fixing base 8, and the lower side of the chair frame A is rotationally connected with the chair frame support bases 15; and the bottom tube 16 is arranged on the ground.

Preferably, one side of the lower rocker fixing base 14 is arranged at the rear end of the bottom tube 16 in a sleeving manner, and the other side of the lower rocker fixing base 14 is rotationally connected with the rocker 13.

In a preferred embodiment, each rocker assembly B further includes a bottom tube base 17 which is used for supporting a front lower part of the chair frame and arranged at the front end of the bottom tube 16.

In a preferred embodiment, the lower rocker fixing base 14, the chair frame support base 15, or the bottom tube base 17 is designed to have an uneven bottom.

In order to reduce surface impact and abrasion caused by repeated contact between the chair frame and the bottom tube 16 during forward and backward rocking of the chair frame, a soft supporting pad 18 is arranged at a contact part between a rear lower part of the chair frame and the bottom tube 16.

Each rocker assembly B in this embodiment further includes an upper torsional spring cover 10 and a lower torsional spring cover 12 which are respectively connected with the upper rocker 9 and the lower rocker 13, wherein the torsional spring 11 is installed between the upper torsional spring cover 10 and the lower torsional spring cover 12, thus being prevented against direct exposure and guaranteeing reliable connection and fixation between the upper rocker 9 and the lower rocker 13.

Figure 6:
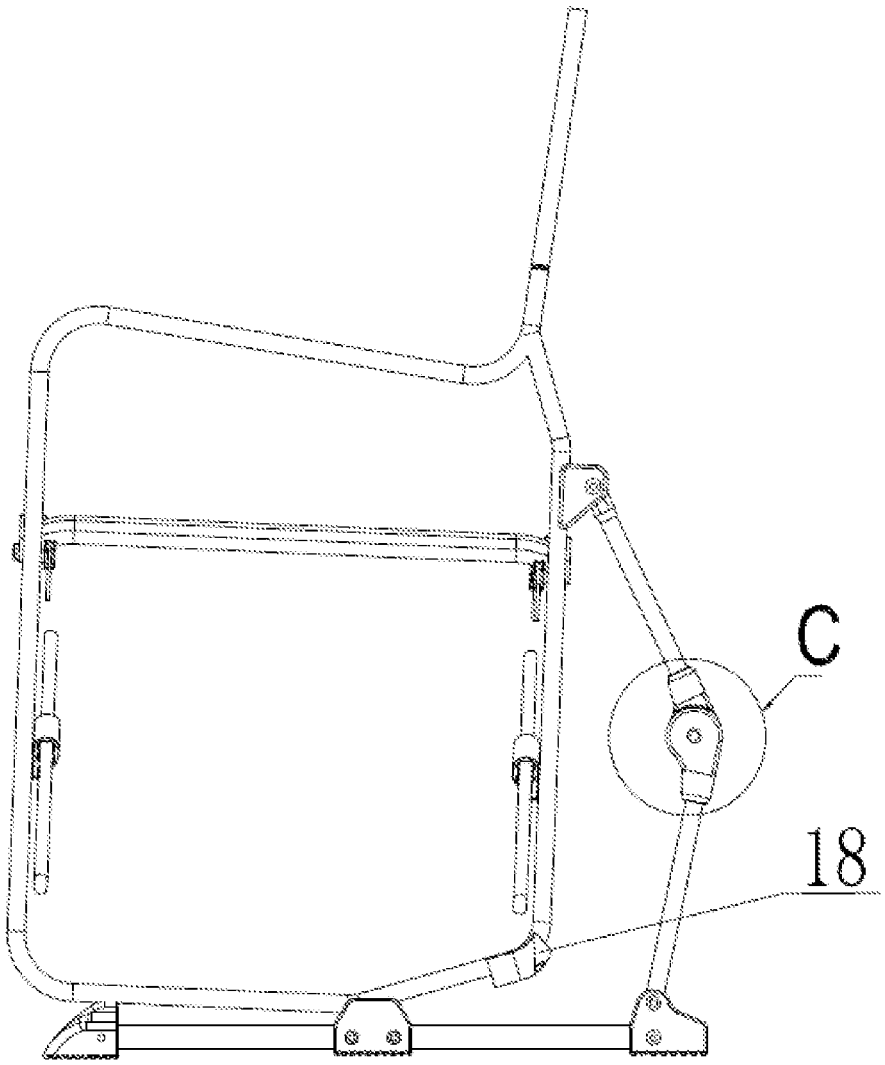
FIG. 6 is a schematic diagram of the rockable folding chair in a natural stationary state.
Figure 7:
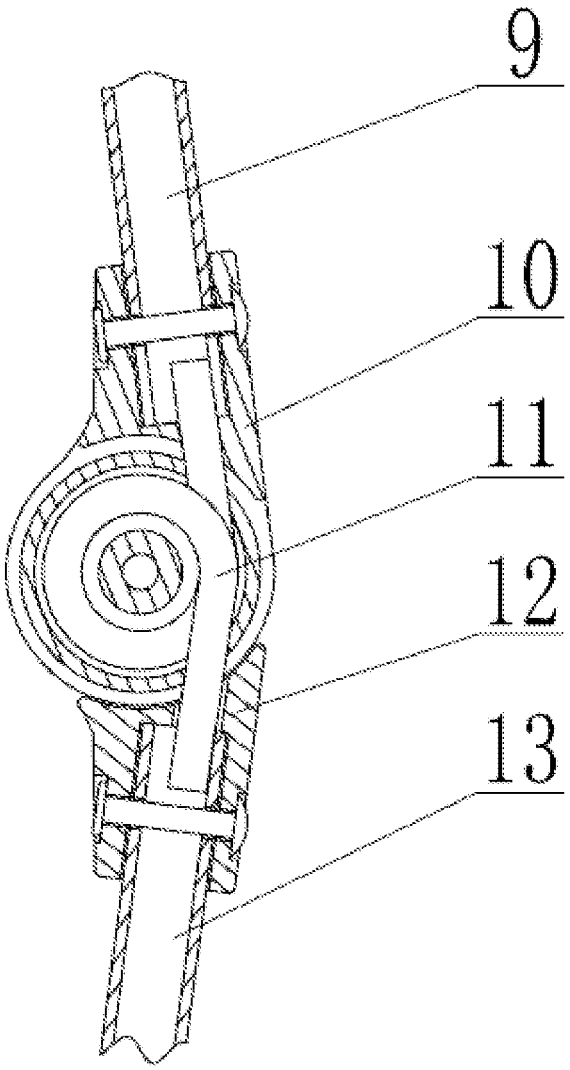
FIG. 7 is an enlarged view of part C in FIG. 6.

Particularly, the upper end of the upper rocker 9 is connected into a slot of the upper rocker fixing base 8 through a rivet and is able to axially rotate around the rivet, and the lower end of the upper rocker 9 is inserted into a circular hole of the upper torsional spring cover 10 to be integrally fixed to the upper torsional spring cover 10 through a rivet, as shown in FIG. 7; the lower torsional spring cover 12 is buckled on the upper torsional spring cover 10 through a rivet and is able to axially rotate around the rivet, and a cavity used for installing the torsional spring 11 is formed in a fastener; the upper end of a steel wire of the torsional spring 11 is inserted into a hole in the upper torsional spring cover 10 and enters the upper rocker 9, the lower end of the steel wire of the torsional spring 11 is inserted into a hole in the lower torsional spring cover 12 and enters the lower rocker 13, and a ring of the torsional spring is disposed around a circular protrusion in the middle of the upper torsional spring cover 10, as shown in FIG. 6 and FIG. 7; the upper end of the lower rocker 13 is inserted into a circular hole of the lower torsional spring cover 12 to be integrally fixed to the lower torsional spring cover 12 through a rivet, and the lower end of the lower rocker 13 is connected into a slot of the lower rocker fixing base 14 through a rivet and is able to axially rotate around the rivet; the bottom tube 16 has the rear end inserted into the lower rocker fixing base 14 and the front end inserted into the bottom tube base 17, and the bottom tube 16, the lower rocker fixing base 14, and the bottom tube base 17 are integrally connected through a rivet; and the lower parts of the two corresponding chair frame support bases 15 are buckled and riveted to the middle of the bottom tube 16, the support shaft 6 is received in a fastener through the upper parts of the two chair frame support bases 15, and the side frame tube 2 axially rotates around the support shaft 6.

The foldable chair frame A includes a left folding chair frame and a right folding chair frame which are symmetrically arranged and are connected through a middle foldable connection frame.

Preferably, the left folding chair frame and the right folding chair frame are of the same structure. The left folding chair frame or the right folding chair frame of the same structure in this embodiment includes a back tube 1, a side frame tube 2, two connection sheets 3, a support shaft 6, and two seat support tubes 7, wherein the side frame tube 2 is a closed ring formed by bending and welding of a tube and has a rear upper part allowing the necked back tube 1 to be inserted therein and a lower part provided with the support shaft 6 (which can be fixed by welding) which is rotationally connected with the corresponding chair frame support bases 15; and the connection sheets 3 are respectively arranged at a front upper part and the rear upper part of the side frame tube 2, the support tubes 7 are respectively arranged at a front lower part and a rear lower part of the side frame tube 2, and the connection sheets 3 and the support tubes 7 are respectively connected with the foldable connection frame and are riveted through rivets to be installed.

The lower ends of the back tubes 1 in this embodiment are necked to be installed in openings in rear top ends of the side frame tubes 2 of the left folding chair frame and the right folding chair frame in a pluggable manner. Two sides of the upper part of the reclining cushion 19 are respectively fixed to the two back tubes 1, and two sides of the lower part of the reclining cushion 19 are respectively fixed to the left folding chair frame and the right folding chair frame and are particularly fixed to the front upper parts of the side frame tubes 2.

The upper rocker fixing bases 8 of the rocker assemblies B in this embodiment are connected to the upper parts of the side frame tubes 2 through rivets to be fixed.

In a preferred embodiment, each side frame tube 2 is a quadrangular or pentagonal ring formed by bending of a tube, a front bottom segment of the side frame tube 2 is a horizontal tube, and a rear bottom segment of the side frame tube 2 is an upward bent tube, as shown in FIG. 6.

The foldable connection frame in this embodiment includes two cross-riveted U-shaped bottom tubes 5 each having two upper ends respectively riveted to the connection sheets 3 located at a front upper part and a rear upper part of the corresponding support shaft 6 as well as two middle ends respectively riveted to the two seat support tubes 7 located on the support shaft 6.

Preferably, the support tubes 7 are sleeved with sliding rings 4; and the lower parts of open ends of the left U-shaped bottom tube 5 are riveted to lug bosses located on the right sliding rings 4, and the lower parts of open ends of the right U-shaped bottom tube 5 are riveted to lug bosses located on the left sliding rings 4.

The whole chair frame A in this embodiment primarily includes two back tubes 1, two side frame tubes 2, four connection sheets 3, four sliding rings 4, two U-shaped bottom tubes 5, two support shafts 6, and four seat support tubes 7, wherein the two U-shaped bottom tubes 5 are crosswise riveted to connect the left chair frame with the right chair frame, so that the whole chair frame is foldable. Each rocker assembly B primarily includes one upper rocker fixing base 8, one upper rocker 9, one upper torsional spring cover 10, one torsional spring 11, one lower torsional spring cover 12, one lower rocker 13, one lower rocker fixing base 14, two chair frame support bases 15, one bottom tube 16, and a bottom tube base 17, so that the rocking chair is able to rock forward and backwards.

Figure 8:
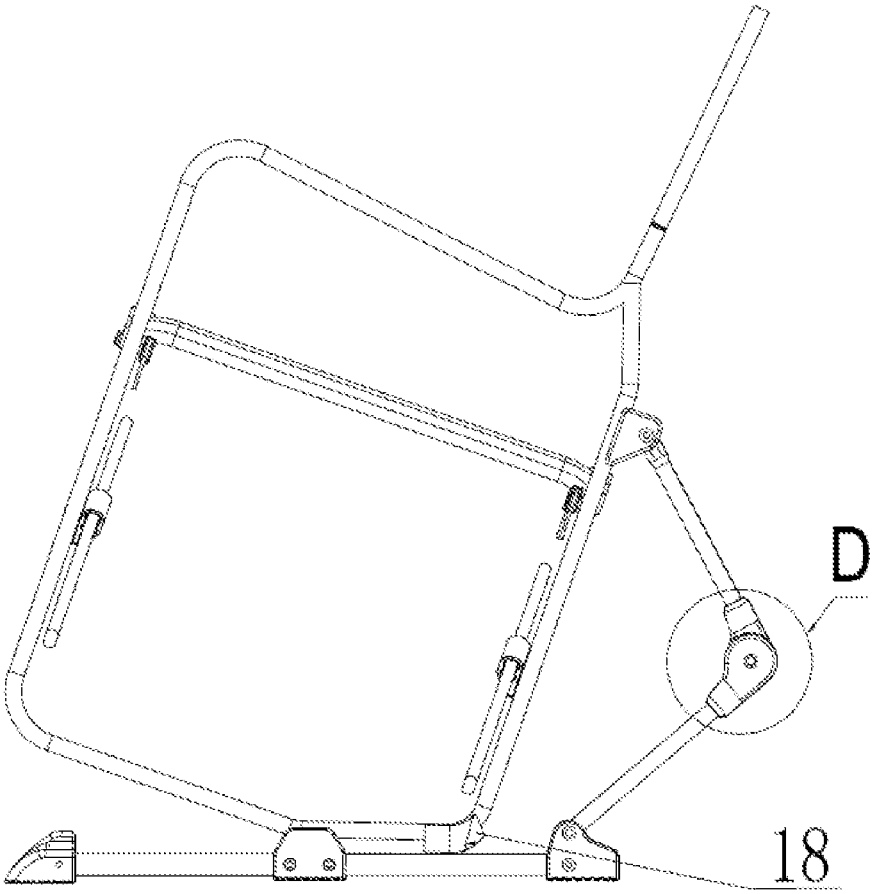
FIG. 8 is a schematic diagram of the rockable folding chair in a rocking state.
Figure 9:
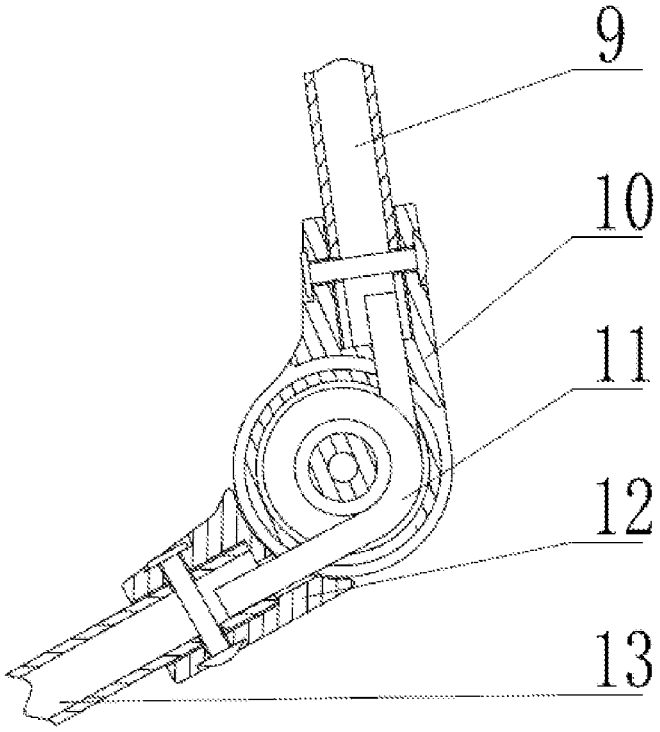
FIG. 9 is an enlarged view of part D in FIG. 8.

The forward and backward rocking process and principle of the rockable folding chair in this embodiment are as follows:

The fastener of each lower rocker fixing base 14, the fastener of the corresponding chair frame support bases 15, and the corresponding bottom tube base 17 make contact with the ground all the time, so that the corresponding lower rocker 13 connected with the lower rocker fixing base 14 rotates, and the support shaft 6 received in the fastener of the frame support bases 15 drives the whole chair frame A to rotate at the same time, as shown in FIG. 8 and FIG. 9. When the chair frame A is pushed by a backward pushing force, the whole chair frame A axially rotates backwards around the support shaft 6, and the upper rocker fixing bases 8 fixed to the side frame tubes 2 in the chair frame A push the upper rockers 9 to axially rotate around the rivets used for connecting the upper rocker fixing bases 8 with the upper rockers 9 at this moment and to downwards press the upper torsional spring covers 10. The upper torsional spring covers 10 and the lower torsional spring covers 12 are connected through the rivets and can axially rotate around the rivets, and the lower rockers 13 connected with the lower torsional spring covers 12 have the lower ends connected with the lower rocker fixing bases 14 in contact with the ground and axially rotate around the connection rivets, so that when the upper torsional spring covers 10 are stressed to move downwards, the lower rockers 13 together with the lower torsional spring covers 12 axially rotate downwards around the rivets located on the lower rocker fixing bases 14, and the upper torsional spring covers 10 and the lower torsional spring covers 12 rotate oppositely at the same time. Thus, the torsional springs 11 in the upper torsional spring covers 10 and the lower torsional spring covers 12 rotate inwards to tighten the springs till the side frame tubes 2 in the chair frame A abut against the bottom tubes 16. At this moment, the rockable folding chair rocks backwards to an extreme position. When a downward force is eliminated, the rockable folding chair stretches towards two sides under the effect of restoring forces from the tightened springs to drive the upper torsional spring covers 10 and the upper rockers 9 located on the upper torsional spring covers 10 to rotate reversely and the lower torsional spring covers 12 and the lower rockers 13 located on the lower torsional spring covers 12 to rotate reversely. The lower ends of the lower rockers 13 are connected with the lower rocker fixing bases 14 in contact with the ground, so that the upper rockers 9 continuously push the chair frame A to rotate upwards accompanied with the increase of an angle between the upper rockers 9 and the lower rockers 13 till the rockable folding chair restores to a natural state. The rockable folding chair can continuously rock forwards and backwards by repeated application and elimination of the downward pressing force.

Figure 10:
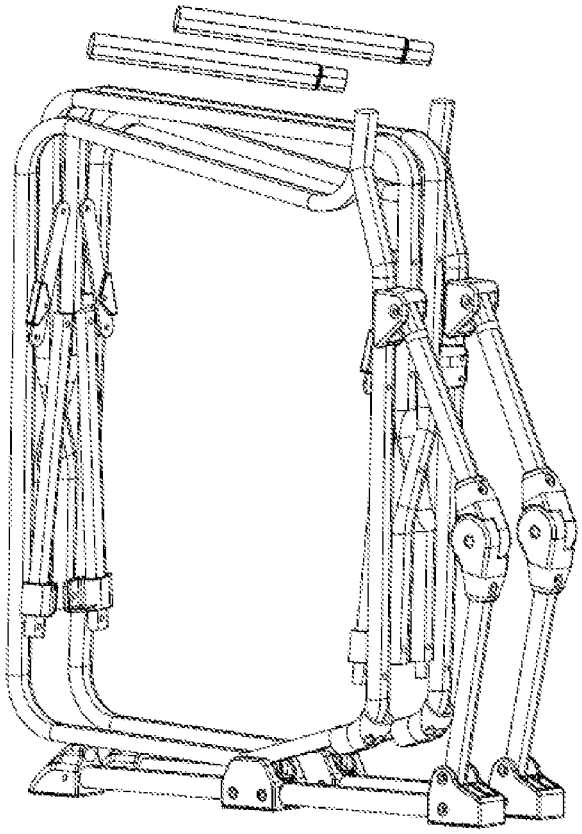
FIG. 10 is a schematic diagram of the rockable folding chair in a folded state.

The folding and unfolding processes of the rockable folding chair in this embodiment are as follows:

When the rockable folding chair needs to be folded, horizontal pipes of the two U-shaped bottom tubes 5 are grasped with two hands to draw close to each other forcedly, and the two cross U-shaped bottom tubes 5 rotate axially around rivets located at junctions to be folded at this moment. The lower parts of the open ends of the U-shaped bottom tubes 5 are respectively riveted to the lug bosses of the sliding rings 4 on the seat support tubes 7 in the left chair frame, the upper parts of the open ends of the U-shaped bottom tubes 5 are respectively riveted to the two connection sheets and the two seat support tubes 7 in the right chair frame, so that the seat support tubes 7 axially rotate around the rivets, and the two U-shaped bottom tubes 5 push the sliding rings 4 to move downwards along the seat support tubes 7 so as to pull the lower parts of the side frame tubes 2 on two sides to simultaneously inwards draw close to each other to be folded. Meanwhile, the connection sheets 3 also axially rotate around the rivets to pull the upper parts of the side frame tubes 2 on two sides to simultaneously inwards draw close to each other to be folded and to drive the rocker assemblies B fixed to the side frame tubes 2 to be folded simultaneously till the two U-shaped bottom tubes 5 are in contact. In this way, the rockable folding chair is folded, and then the back tubes 1 are pulled out, as shown in FIG. 10.

Figure 11:
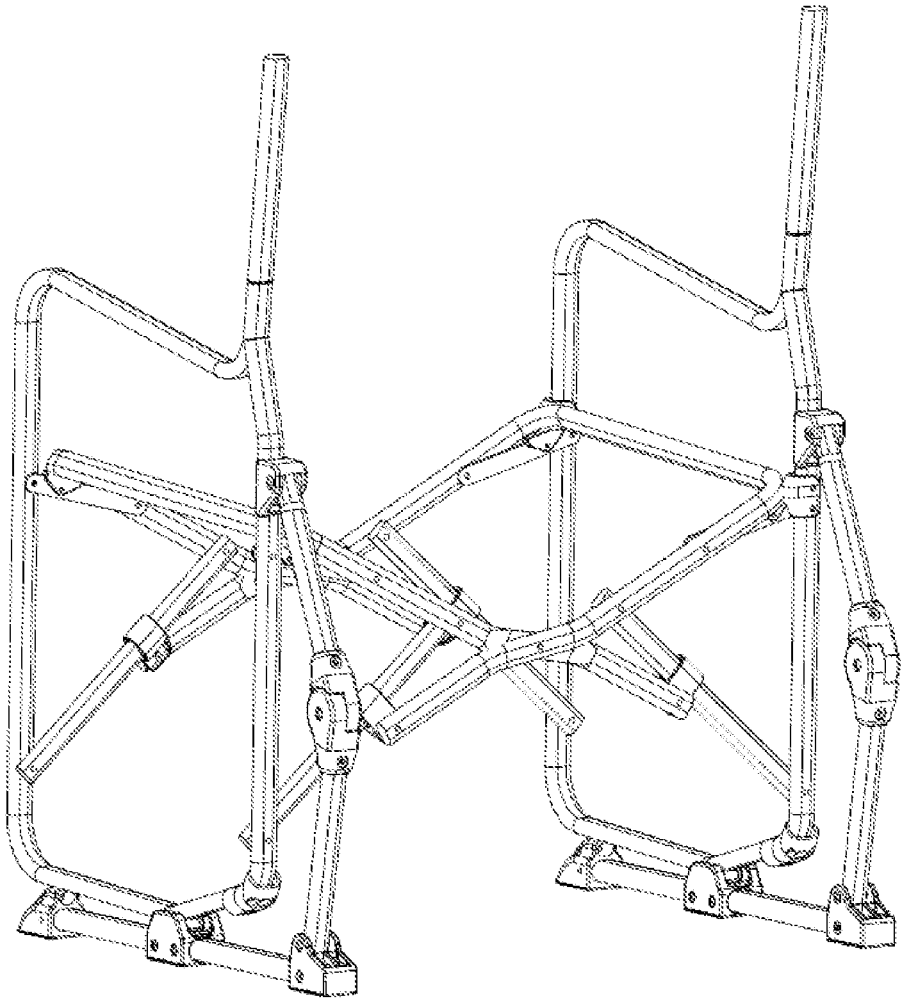
FIG. 11 is a schematic diagram of the rockable folding chair in an unfolded state.

When the rockable folding chair needs to be unfolded, the horizontal pipes of the two U-shaped bottom tubes 5 are grasped by two hands to be forcedly separated towards two sides, at this moment, the two U-shaped bottom tubes 5 are axially separated around the rivets located at the junctions to drive the connection sheets 3 riveted to the two U-shaped bottom tubes 5 to push the upper parts of the side frame tubes 2 on two sides to move outwards. Meanwhile, the lower parts of the open ends of the U-shaped bottom tubes 5 pull the sliding rings 4 to downwards move along the seat support tubes 7 and push the lower parts of the side frame tubes 2 on two sides to simultaneously move outwards to drive the rocker assemblies B fixed to the side frame tubes 2 to simultaneously move outwards till the two U-shaped bottom tubes 5 press against the connection sheets 3. In this way, the rockable folding chair is unfolded, and then the back tubes 1 are inserted, as shown in FIG. 11.

The above embodiments are preferred ones of the invention, and are not intended to limit the protection scope of the invention. All transformations and improvements achieved by those skilled in the art on the basis of the design conception of the invention should fall within the protection scope of the invention. Particularly, various transformations and improvements of components and/or layouts of the combined structure of the subject matter can be made within the scope of this application, the accompanying drawings, and the claims. Those skilled in the art can achieve other clear purposes of the invention except the transformations and improvements of the components and/or layouts.

What is claimed is:

1. A rockable folding chair, comprising a chair frame, a reclining cushion, and two rocker assemblies, wherein the chair frame includes a left folding chair frame and a right folding chair frame which are symmetrically arranged and are connected through a middle foldable connection frame, and the two rocker assemblies are respectively symmetrically arranged on rear sides of the left folding chair frame and the right folding chair frame;

each said rocker assembly includes an upper rocker (9), a torsional spring (11), a lower rocker (13), and a bottom tube (16), wherein a lower end of the upper rocker (9) and an upper end of the lower rocker (13) are respectively connected with two ends of the torsional spring (11), and a lower end of the lower rocker (13) is rotationally connected with a rear end of the bottom tube (16) which is arranged on a ground;

the left folding chair frame and the right folding chair frame have bottoms respectively rotationally connected with the bottom tubes (16) as well as rear upper ends respectively articulated to the upper rockers (9); and pluggable back tubes (1) are respectively arranged at rear top ends of the left folding chair frame and the right folding chair frame; and two sides of an upper part of the reclining cushion are respectively fixed to the two back tubes (1), and two sides of a lower part of the reclining cushion are respectively fixed to the left folding chair frame and the right folding chair frame.

2. The rockable folding chair according to claim 1, wherein the left folding chair frame or the right folding chair frame includes a side frame tube (2), two connection sheets (3), a support shaft (6), and two seat support tubes (7), wherein:

the side frame tube (2) is a closed ring formed by bending and welding of a tube, and a lower end of the corresponding back tube (1) is necked to be installed in an opening in a rear upper part of the side frame tube (2) in a pluggable manner; the support shaft (6) is arranged at a bottom of the side frame tube (2) and is rotationally connected with the corresponding bottom tube (16); and the connection sheets (3) are respectively arranged at a front upper part and the rear upper part of the side frame tube (2), the support tubes (7) are respectively arranged at a front lower part and a rear lower part of the side frame tube (2), and the connection sheets (3) and the support tubes (7) are respectively connected with the foldable connection frame.

3. The rockable folding chair according to claim 2, wherein the side frame tubes (2) are quadrangular or pentagonal rings.

4. The rockable folding chair according to claim 2, wherein the foldable connection frame includes two cross-riveted U-shaped bottom tubes (5) each having two bending ends respectively riveted to the connection sheets (3) located at the front upper part and the rear upper part of the corresponding side frame tube (2) as well as two middle ends respectively riveted to the two seat support tubes (7) located on the corresponding side frame tube (2).

5. The rockable folding chair according to claim 4, wherein the support tubes (7) are sleeved with sliding rings (4); and lower parts of open ends of the left U-shaped bottom tube (5) are riveted to lug bosses located on the right sliding rings (4), and lower parts of open ends of the right U-shaped bottom tube (5) are riveted to lug bosses located on the left sliding rings (4).

6. The rockable folding chair according to claim 1, wherein supporting pads (18) are arranged at contact parts between a rear lower part of the left folding chair frame or the right folding chair frame and the bottom tubes (16).

7. The rockable folding chair according to claim 2, wherein supporting pads (18) are arranged at contact parts between a rear lower part of the left folding chair frame or the right folding chair frame and the bottom tubes (16).

8. The rockable folding chair according to claim 3, wherein supporting pads (18) are arranged at contact parts between a rear lower part of the left folding chair frame or the right folding chair frame and the bottom tubes (16).

9. The rockable folding chair according to claim 1, wherein each said rocker assembly further includes an upper rocker fixing base (8), a lower rocker fixing base (14), and a chair frame support base (15), wherein the upper rocker fixing base (8) is rotationally connected with the upper rocker (9), and two ends of the lower rocker fixing base (14) are respectively connected with the lower rocker (13) and the bottom tube (16); and the rear upper part of the side frame tube (2) is fixedly connected with the upper rocker fixing base (8), and the support shaft (6) is rotationally connected with the chair frame support base (15).

10. The rockable folding chair according to claim 2, wherein each said rocker assembly further includes an upper rocker fixing base (8), a lower rocker fixing base (14), and a chair frame support base (15), wherein the upper rocker fixing base (8) is rotationally connected with the upper rocker (9), and two ends of the lower rocker fixing base (14) are respectively connected with the lower rocker (13) and the bottom tube (16); and the rear upper part of the side frame tube (2) is fixedly connected with the upper rocker fixing base (8), and the support shaft (6) is rotationally connected with the chair frame support base (15).

11. The rockable folding chair according to claim 3, wherein each said rocker assembly further includes an upper rocker fixing base (8), a lower rocker fixing base (14), and a chair frame support base (15), wherein the upper rocker fixing base (8) is rotationally connected with the upper rocker (9), and two ends of the lower rocker fixing base (14) are respectively connected with the lower rocker (13) and the bottom tube (16); and the rear upper part of the side frame tube (2) is fixedly connected with the upper rocker fixing base (8), and the support shaft (6) is rotationally connected with the chair frame support base (15).

12. The rockable folding chair according to claim 9, wherein each said rocker assembly further includes a bottom tube base (17) which is used for supporting a front lower part of the chair frame and arranged at a front end of the bottom tube (16).

13. The rockable folding chair according to claim 10, wherein each said rocker assembly further includes a bottom tube base (17) which is used for supporting a front lower part of the chair frame and arranged at a front end of the bottom tube (16).

14. The rockable folding chair according to claim 11, wherein each said rocker assembly further includes a bottom tube base (17) which is used for supporting a front lower part of the chair frame and arranged at a front end of the bottom tube (16).

15. The rockable folding chair according to claim 12, wherein the lower rocker fixing base (14), the chair frame support base (15), or the bottom tube base (17) has an uneven bottom.

16. The rockable folding chair according to claim 13, wherein the lower rocker fixing base (14), the chair frame support base (15), or the bottom tube base (17) has an uneven bottom.

17. The rockable folding chair according to claim 14, wherein the lower rocker fixing base (14), the chair frame support base (15), or the bottom tube base (17) has an uneven bottom.

18. The rockable folding chair according to claim 9, wherein each said rocker assembly further includes an upper torsional spring cover (10) and a lower torsional spring cover (12) which are respectively connected with the upper rocker (9) and the lower rocker (13), wherein the torsional spring (11) is installed between the upper torsional spring cover (10) and the lower torsional spring cover (12).

19. The rockable folding chair according to claim 10, wherein each said rocker assembly further includes an upper torsional spring cover (10) and a lower torsional spring cover (12) which are respectively connected with the upper rocker (9) and the lower rocker (13), wherein the torsional spring (11) is installed between the upper torsional spring cover (10) and the lower torsional spring cover (12).

20. The rockable folding chair according to claim 11, wherein each said rocker assembly further includes an upper torsional spring cover (10) and a lower torsional spring cover (12) which are respectively connected with the upper rocker (9) and the lower rocker (13), wherein the torsional spring (11) is installed between the upper torsional spring cover (10) and the lower torsional spring cover (12).

* * * * *